US008820476B2

(12) United States Patent
Nam et al.

(10) Patent No.: US 8,820,476 B2
(45) Date of Patent: Sep. 2, 2014

(54) ASSEMBLY WALL BODY HAVING IMPROVED SOUND ABSORBING AND SCREENING PERFORMANCE AND A ASSEMBLY STRUCTURE COMPRISING THE SAME

(75) Inventors: Jin-Woo Nam, Seoul (KR); Seong-Moon Jung, Yuseong-gu Daejeon (KR); Jun-Yup Kim, Cheongju-si (KR); Heon-Sung Kang, Cheongju-si (KR)

(73) Assignee: LG Hausys, Ltd., Seoul (KR)

( * ) Notice: Subject to any disclaimer, the term of this patent is extended or adjusted under 35 U.S.C. 154(b) by 0 days.

(21) Appl. No.: 13/640,587

(22) PCT Filed: Apr. 12, 2011

(86) PCT No.: PCT/KR2011/002562

§ 371 (c)(1),
(2), (4) Date: Oct. 11, 2012

(87) PCT Pub. No.: WO2011/129580

PCT Pub. Date: Oct. 20, 2011

(65) Prior Publication Data

US 2013/0025966 A1 Jan. 31, 2013

(30) Foreign Application Priority Data

Apr. 12, 2010 (KR) ..... 10-2010-0033199

(51) Int. Cl.
*E04B 1/82* (2006.01)
*E04B 1/84* (2006.01)
*E04C 2/34* (2006.01)

(52) U.S. Cl.
USPC ..... 181/290; 181/284; 181/286; 181/293; 181/294; 52/145; 52/794.1

(58) Field of Classification Search
USPC ..... 181/290, 293, 294, 284, 286; 52/145, 52/794.1
See application file for complete search history.

(56) References Cited

U.S. PATENT DOCUMENTS 2,177,393 A * 10/1939 Parkinson ..... 52/145
2,582,144 A * 1/1952 Miles ..... 52/404.1

(Continued)

FOREIGN PATENT DOCUMENTS

CN 1981100 A 6/2007
JP S47-005508 U 9/1972

(Continued)

*Primary Examiner* — David Warren
*Assistant Examiner* — Christina Russell
(74) *Attorney, Agent, or Firm* — Nath, Goldberg & Meyer; Jerald L. Meyer; Stanley N. Protigal

(57) ABSTRACT

The present invention relates to an assembly wall having improved sound absorption/insulation performance and an assembly structure thereof. The assembly wall includes plate members separated from each other to face each other and each forming at least one layer; stud members alternately placed on different inner surfaces of the plate members and comprising a web formed with a plurality of first perforated holes having at least one diameter; an insulation member interposed in a space defined between the plate members and the stud members; and a sheet member adjoining an outer surface of the insulation member and being formed with a plurality of second perforated holes having at least one diameter. With this structure, the assembly wall has excellent sound absorption and insulation performance over various frequency bands including a low frequency band without increasing wall thickness.

8 Claims, 5 Drawing Sheets

(56) References Cited

U.S. PATENT DOCUMENTS

| | | | | | |
|---|---|---|---|---|---|
| 2,914,147 | A | * | 11/1959 | Millard | 52/222 |
| 3,497,029 | A | * | 2/1970 | Stark | 181/30 |
| 3,867,995 | A | * | 2/1975 | Sanders | 181/285 |
| 4,130,175 | A | * | 12/1978 | Hehmann | 181/290 |
| 4,285,184 | A | * | 8/1981 | Turner, Jr. | 52/745.15 |
| 4,441,581 | A | * | 4/1984 | Sommerhalder | 181/286 |
| 4,471,592 | A | * | 9/1984 | MacKinnon et al. | 52/404.2 |
| 4,487,291 | A | * | 12/1984 | Walker | 181/290 |
| 4,838,524 | A | * | 6/1989 | McKeown et al. | 256/24 |
| 5,297,369 | A | * | 3/1994 | Dickinson | 52/281 |
| 5,561,958 | A | * | 10/1996 | Clement et al. | 52/407.1 |
| 5,661,273 | A | * | 8/1997 | Bergiadis | 181/290 |
| 6,122,867 | A | * | 9/2000 | Leconte | 52/144 |
| 6,253,516 | B1 | * | 7/2001 | D'Andrea et al. | 52/582.1 |
| 6,622,818 | B2 | * | 9/2003 | Jenvey | 181/224 |
| 2002/0066253 | A1 | * | 6/2002 | Smith | 52/729.1 |
| 2003/0114062 | A1 | * | 6/2003 | Scott et al. | 442/181 |
| 2006/0272282 | A1 | * | 12/2006 | Aida et al. | 52/796.1 |
| 2013/0078422 | A1 | * | 3/2013 | Tinianov et al. | 428/138 |

FOREIGN PATENT DOCUMENTS

| | | | | |
|---|---|---|---|---|
| JP | S61-194007 | U | | 12/1986 |
| JP | H08-260597 | A | | 10/1996 |
| JP | 09-268677 | A | | 10/1997 |
| JP | 09268677 | A | * | 10/1997 |
| JP | 2004-084216 | A | | 3/2004 |
| JP | 2005-105807 | A | | 4/2005 |
| JP | 2005-163476 | A | | 6/2005 |
| KR | 20-2000-0012429 | A | | 7/2000 |
| KR | 2000-0012429 | U | | 7/2000 |
| KR | 10-0675225 | B1 | | 1/2006 |
| KR | 2006000055 | A | * | 1/2006 |
| KR | 10-0693194 | B1 | | 5/2006 |
| KR | 10-0672831 | A | | 1/2007 |
| KR | 10-0838961 | B1 | | 2/2008 |
| KR | 10-2010-0035306 | A | | 4/2010 |
| KR | 2010035306 | A | * | 4/2010 |

* cited by examiner

ASSEMBLY WALL BODY HAVING IMPROVED SOUND ABSORBING AND SCREENING PERFORMANCE AND A ASSEMBLY STRUCTURE COMPRISING THE SAME

This is a National Phase Application filed under 35 U.S.C. 371 as a national stage of PCT/KR2011/002562, filed Apr. 12, 2011, and claims priority from Korean Application No. 10-2010-0033199, filed Apr. 12, 2010, the content of each of which is hereby incorporated by reference in its entirety.

TECHNICAL FIELD

The present invention relates to an assembly wall having improved sound absorption/insulation performance and an assembly structure thereof, and more particularly, to an assembly wall having improved sound absorption/insulation performance, in which micro-perforated holes of various sizes are formed on a web of a stud to provide a resonator-shaped shape, a functional sheet member having the micro-perforated holes adjoins an outer surface of an insulation member, thereby providing excellent sound absorption/insulation performance over various frequency bands including a low frequency band without increasing the thickness of the wall.

BACKGROUND ART

Unlike general walls, an assembly wall placed between a floor and the ceiling of a building such as multipurpose buildings, apartments, steel houses, etc., is designed not as a load bearing wall for bearing structural load of the building, but as a wall for effective use of a space.

Further, such an assembly wall generally includes stud and plate members.

In a general process of manufacturing an assembly wall, a track called a runner is adhered to the floor and the ceiling.

Then, studs are fastened to the runner to form a framework.

After construction of the framework, electricity and plumbing works are performed. Then, an insulation member is inserted into a space between the studs to provide thermal insulation and sound absorption functions to the assembly wall.

Finally, plate members, i.e. exterior members for the wall, are mounted on the studs to provide sound insulation and fireproofing functions to the assembly wall.

Conventionally, improved sound absorption/insulation performance of the assembly wall can be achieved only by a method of manufacturing an assembly wall using expensive sound insulation boards having excellent sound insulation performance, or a method of blocking sound waves by thickening the assembly wall.

However, both thickening of the assembly wall and use of the expensive sound insulation boards cause a significant increase in cost and is uneconomical and inefficient, thereby lowering competitiveness in production.

Therefore, there is an urgent need for an assembly wall, which permits effective improvement in sound absorption/insulation performance without using expensive sound insulation boards or increasing the thickness of the wall.

DISCLOSURE

Technical Problem

The present invention is directed to an assembly wall, which permits effective improvement in sound absorption/insulation performance using inexpensive plate-shaped building materials without thickening the wall.

The present invention is also directed to an assembly structure, which permits effective improvement in sound absorption/insulation performance using an assembly wall having improve sound absorption/insulation performance and a reinforced structure supporting the assembly wall.

Technical Solution

One aspect of the present invention provides an assembly wall having improved sound absorption/insulation performance, which includes: plate members separated from each other to face each other and each forming at least one layer; stud members alternately placed on different inner surfaces of the plate members and comprising a web formed with a plurality of first perforated holes having at least one diameter; an insulation member interposed in a space defined between the plate members and the stud members; and a sheet member adjoining an outer surface of the insulation member and being formed with a plurality of second perforated holes having at least one diameter.

The first perforated holes and the second perforated holes may have different diameters depending on a major sound absorption frequency.

The first perforated holes and the second perforated holes may have a diameter ranging from 0.1 mm to 5 mm.

The plate members may include a material having sound insulation and fireproof functions.

The plate members may include one material selected from among gypsum boards, magnesium oxide (MgO) boards, ceramic boards, cement boards, and lightweight concrete panels.

The insulation member may include a material having thermal insulation and sound absorption functions.

The insulation member may include one of rock wool, mineral wool, glass wool, ceramic fibers, polyethylene terephthalate (PET) nonwoven fibers, cellulose fibers, and various foaming materials.

Another aspect of the present invention provides an assembly wall having improved sound absorption/insulation performance, which includes: plate members separated from each other to face each other and each forming at least one layer; stud members placed on respective inner surfaces of the plate members to be arranged in double lines within a space between the plate members, each of the stud members comprising a web formed with a plurality of first perforated holes having at least one diameter; insulation members arranged in double lines along the arranged lines of the stud members; and sheet members adjoining outer surfaces of the insulation members and being formed with a plurality of second perforated holes having at least one diameter.

The aforementioned assembly wall is a stagger stud type assembly wall, and this assembly wall is a double stud type assembly wall.

The first perforated holes and the second perforated holes may have different diameters depending on a major sound absorption frequency.

The first perforated holes and the second perforated holes may have a diameter ranging from 0.1 mm to 5 mm.

The plate members may include a material having sound insulation and fireproof functions.

The plate members may include one material selected from among gypsum boards, magnesium oxide (MgO) boards, ceramic boards, cement boards, and lightweight concrete panels.

The insulation members may include a material having thermal insulation and sound absorption functions.

The insulation members may include one of rock wool, mineral wool, glass wool, ceramic fibers, polyethylene terephthalate (PET) nonwoven fibers, cellulose fibers, and various foaming materials.

A further aspect of the present invention provides an assembly structure having improved sound absorption/insulation performance, which includes: an assembly wall including plate members which are separated from each other to face each other, and each forming at least one layer, stud members which are alternately placed on different inner surfaces of the plate members, and include a web formed with a plurality of first perforated holes having at least one diameter, insulation members which are interposed in spaces between the plate members and the stud members, and sheet members which adjoin outer surfaces of the insulation members and are formed thereon with a plurality of second perforated holes having at least one diameter; and a reinforced structure configured to support the assembly wall.

Advantageous Effects

The assembly wall and the assembly structure according to the present invention may effectively enhance sound absorption/insulation performance using inexpensive plate-shaped building materials without increasing the thickness of the assembly wall.

Namely, in the assembly wall and the assembly structure thereof having improved sound absorption/insulation performance according to the present invention, first perforated holes having various diameters (ranging from 0.1 mm to 5 mm) are formed on a web of a stud member to provide a resonator structure inside the assembly wall. Further, a functional sheet member adjoining an outer surface of an insulation member is formed with second perforated holes having fine diameters, thereby providing excellent sound absorption/insulation performance over various frequency bands including a low frequency band.

BEST MODE

Exemplary embodiments of the present invention will now be described in more detail with reference to the accompanying drawings.

The above and other aspects, features, and advantages of the present invention will become apparent from the detailed description of the following embodiments in conjunction with the accompanying drawings. It should be understood that the present invention is not limited to the following embodiments and may be embodied in different ways, and that the following embodiments are given to provide complete disclosure of the invention and to provide a thorough understanding of the present invention to those skilled in the art. The scope of the invention is defined only by the claims. Detailed descriptions of components apparent to those skilled in the art will be omitted for clarity.

Figure 1:
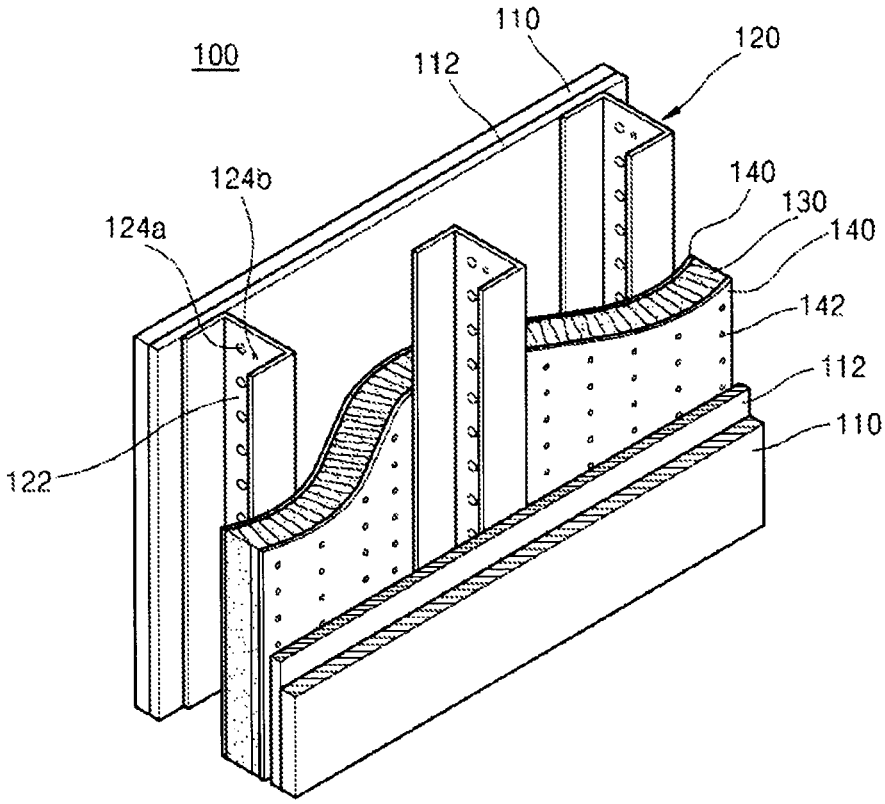
FIG. 1 is a schematic perspective view of an assembly wall having improved sound absorption/insulation performance according to one exemplary embodiment of the present invention.
Figure 2:
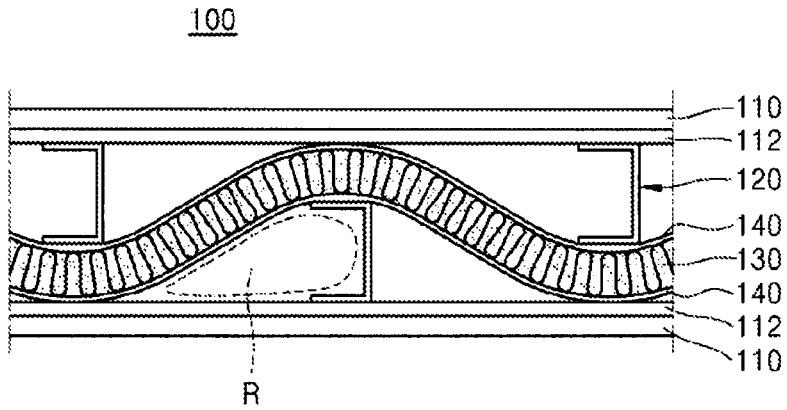
FIG. 2 is a cross-sectional view of the assembly wall of FIG. 1.

FIG. 1 is a schematic perspective view of an assembly wall having improved sound absorption/insulation performance according to one exemplary embodiment of the present invention, and FIG. 2 is a cross-sectional view of the assembly wall of FIG. 1. FIGS. 1 and 2 are illustrated just for clear conceptual understanding of a relationship between the configurations of the present invention, and thus various alternatives may be expected without being limited to the certain shapes shown therein.

Referring to FIGS. 1 and 2, an assembly wall 110 having improved sound absorption/insulation performance according to one exemplary embodiment includes plate members 110, stud members 120, an insulation member 130, and sheet members 140.

First, the plate member 110 will be described.

The plate member 110 refers to a plate-shaped building material forming an outer appearance of the assembly wall 100.

The plate members 110 are separated from each other to face each other.

Each of the plate members 110 constitutes at least one layer.

In this embodiment, each of the plate members 110 includes a single additional layer 112 therein, as shown in FIGS. 1 and 2, without being limited thereto.

As such, although the plate member 110 may include two or more additional layers 112 to enhance solidity and sound insulation performance of the assembly wall, the number of additional layers 112 may be suitably selected in consideration of thickness and cost.

Further, although the plate member 110 may be made of any material, it is advantageous that the plate member 110 be made of one material selected from among general gypsum boards, magnesium oxide (MgO) boards, ceramic boards, cement boards, and lightweight concrete panels, instead of expensive fireproof and sound insulation boards.

That is, since the assembly wall 1100 according to the embodiment has improved sound absorption/insulation performance, it is possible to eliminate expensive fireproof and sound insulation boards for the plate member 110.

Next, the stud members 120 will be described.

As mentioned in the background, the stud member 120 is a building material fastened to a runner placed between a floor and the ceiling of a building to provide a framework of the assembly wall 100.

In this embodiment, the assembly wall 100 employs a stagger type stud as shown in FIGS. 1 and 2. In another embodiment, an assembly wall 200 employs a double type stud, which will be described below with reference to FIGS. 4 and 5.

The stud members 120 are alternately placed on different inner surfaces of the plate members 110.

Specifically, in a structure where the plate members 110 are arranged to face each other, when one stud member 120 is fastened to an inner surface of one plate member 110, the next stud member 120 is fastened to an inner surface of another plate member 110 to be separated a certain distance from the one stud member 120. That is, the stud members 120 are alternately placed on the inner surfaces of the facing plate members 110.

Here, the distance between the stud members 120 varies depending on the width, size and installation conditions of the assembly wall 110. It should be understood that these conditions do not limit the scope of the present invention.

Further, there is no limit as to the material of the stud member 120. However, since the stud members 120 need to be rigid enough to bear horizontal and vertical loads applied to the assembly wall 100, the stud members 120 may be made of steel or any composite material having rigidity similar to that of the steel.

The structure of the stud member 120 will be described in more detail with reference to FIG. 3.

Figure 3:
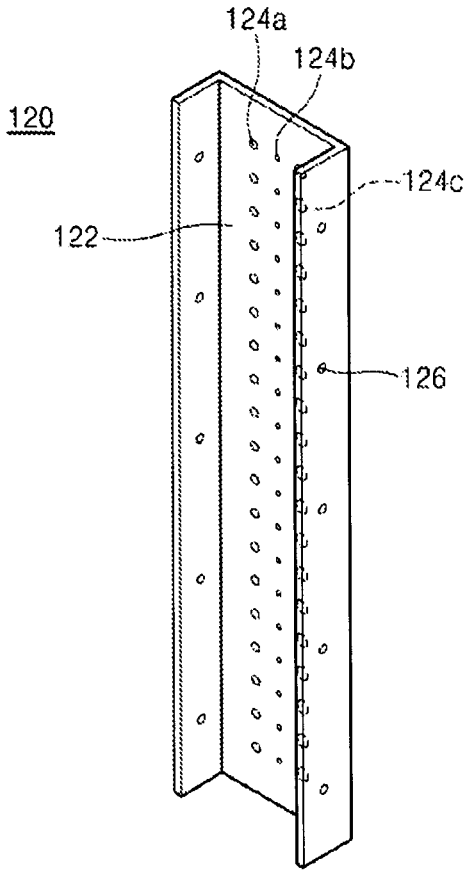
FIG. 3 is a perspective view of a stud member of the assembly wall of FIG. 1.

FIG. 3 is a perspective view of a stud member of the assembly wall of FIG. 1.

In FIG. 3, the stud member 120 is formed at opposite sides thereof with fastening holes 126 to be fastened to the plate member 110. Here, the stud member 120 may be fastened to the plate member 110 through the fastening holes 126 using various fastening means (for example, bolts), and thus a detailed description thereof will be omitted.

Further, a web 122 of the stud member 120 is formed with a plurality of first perforated holes 124*a*, 124*b*, 124*c* having various diameters.

The first perforated holes 124*a*, 124*b*, 124*c* are micro-perforated holes having small diameters.

The diameters of the first perforated holes 124*a*, 124*b*, 124*c* may vary depending on a major sound absorption frequency of the assembly wall 100 having improved sound absorption/insulation performance.

For example, the diameters of the first perforated holes 124*a*, 124*b*, 124*c* may vary in the range from 0.1 mm to 5 mm.

According to the exemplary embodiment of FIG. 3, a first perforated hole indicated by reference numeral 124*a* has a diameter of 4 mm, a first perforated hole indicated by reference numeral 124*b* has a diameter of 0.9 mm, and a first perforated hole indicated by reference numeral 124*c* has a diameter of 3 mm.

The diameter range of the first perforated holes 124*a*, 124*b*, 124*c* may be suitably changed depending on overall design conditions of the assembly wall 100, such as the thickness, size, shape, material, etc. of the plate member 110, and the thickness, size, shape, material, etc. of the web of the stud member 120.

However, when the stud member 120 is manufactured so that the diameters of the first perforated holes 124*a*, 124*b*, 124*c* are much smaller than the lower limit of the diameter range (for example, 0.1 mm), it can be difficult to effectively absorb sound in a low frequency band. On the other hand, when the stud member 120 is manufactured so that the diameters of the first perforated holes 124*a*, 124*b*, 124*c* are much larger than the upper limit of the diameter range (for example, 5 mm), it can be difficult to effectively absorb sound in a high frequency band.

The stud members 120 define a space (see R in FIG. 2), which is partitioned by the plate members 110 and the sheet member 120 described below in more detail. Such a space R (see FIG. 2) serves as a hollow space of a resonator, and provides high sound absorption performance in a low frequency band. Further, the diameters of the first perforated holes 124*a*, 124*b*, 124*c* are previously selected and arranged to provide high sound absorption performance in a high frequency band.

Next, the insulation member 130 will be described.

The insulation member 130 is a building material interposed in a space defined between the plate members 110 and the stud members 120, and has functions of thermal insulation and sound absorption.

The insulation member 130 is typically called a "core material," and generally employs rock wool. For example, the insulation member 130 may employ mineral wool, glass wool, polyethylene terephthalate (PET) non-woven fibers, ceramic fibers, cellulose fibers, various foaming materials, etc.

As shown in FIG. 1, the insulation member 130 according to the exemplary embodiment may be prepared using any of the foregoing materials and may have an air layer between the fibers to provide excellent thermal insulation and sound absorption functions. The insulation member 130 is interposed in a space defined between the stud members 120 placed on the inner surfaces of the plate members 110 within the space defined between the inner surfaces of the plate members 110.

Next, the sheet member 140 will be described.

The sheet member 140 is a thin sheet-shaped member to be placed on the outer surface of the insulation member 130. The wall assembly may include a single sheet member 140 placed on one side of the insulation member 130. Alternatively, the wall assembly may include two sheet members 140 placed on both sides of the insulation member 130, as shown in FIG. 1.

According to exemplary embodiments, the sheet member 140 is formed thereon with a plurality of second perforated holes having a constant diameter or various diameters.

Here, the second perforated holes 142 are micro-perforated holes having small diameters like the first perforated holes 124*a*, 124*b*, 124*c* as described together with the stud member 120.

Like the first perforated holes 124*a*, 124*b*, 124*c*, the diameter range of the second perforated hole 142 may vary depending on the major sound absorption frequency of the assembly wall 100 having improved sound absorption/insulation performance.

The diameter of the second perforated hole 142 may be determined in the range from 0.1 mm to 5 mm (for example, the second perforated hole 142 according to the exemplary embodiment shown in FIG. 1 has a diameter of 1 mm).

The sheet member 140 defines the space (see R in FIG. 2) partitioned by the plate members 110 and the stud members 120. As described above, the space R (see FIG. 2) serves as the hollow space of the resonator, and thus provides sound absorption high performance in a low frequency band.

Further, the sheet member 140 having the second perforated holes 142 has a function of panel type sound absorption as a unique effect due to its distinctive shape. Therefore, the assembly wall 100 has significantly improved sound absorption performance causing high transmission loss.

Hence, the first perforated holes 124*a*, 124*b*, 124*c* of the stud member 120 and the second perforated holes 142 of the sheet member 140 designed to have proper diameters and arrangement improve sound absorption performance of the assembly wall 100 not only in a low frequency band but also in a preset major frequency band.

Next, a double stud type assembly wall 200 according to the present invention will be described with reference to FIGS. 4 and 5.

Figure 4:
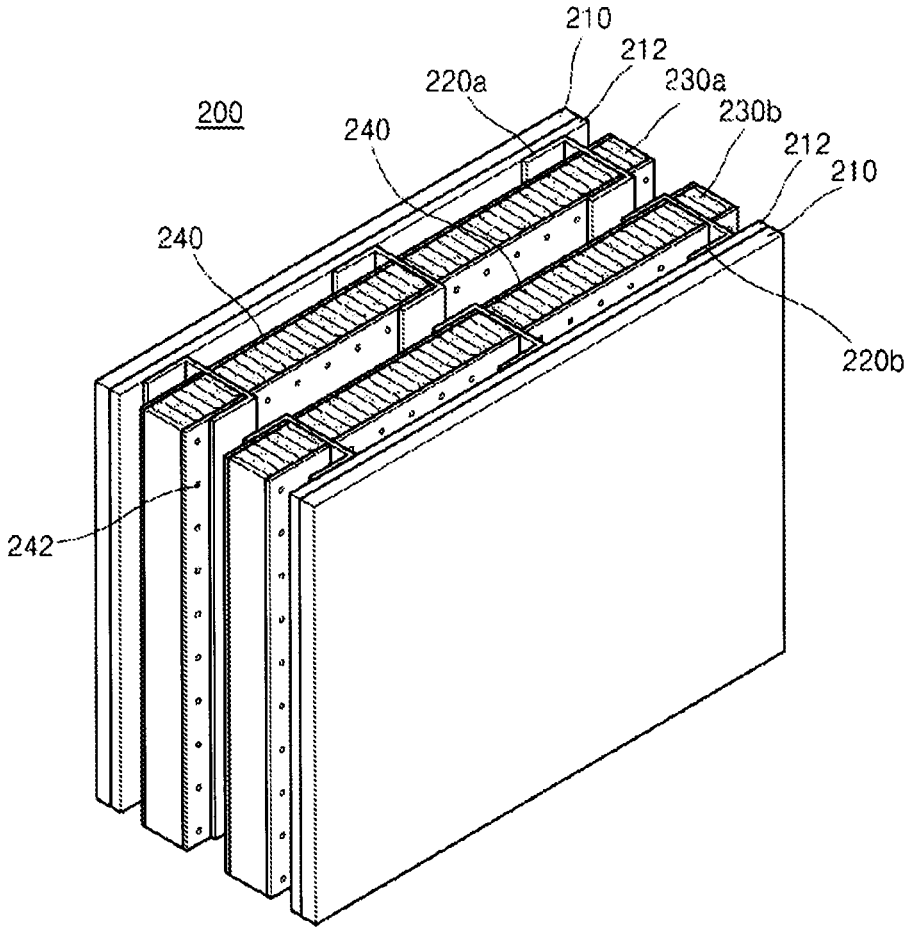
FIG. 4 is a schematic perspective view of an assembly wall having improved sound absorption/insulation performance according to another exemplary embodiment of the present invention.
Figure 5:
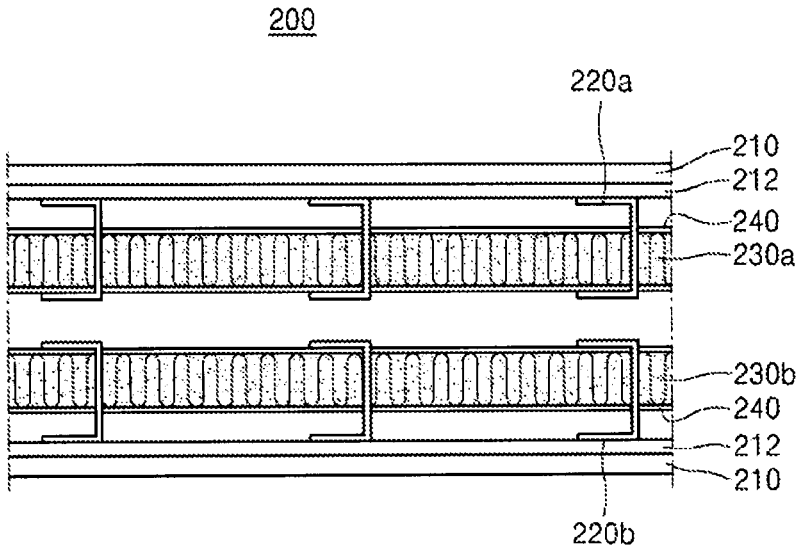
FIG. 5 is a cross-sectional view of the assembly wall of FIG. 4.

FIG. 4 is a schematic perspective view of an assembly wall having improved sound absorption/insulation performance according to another exemplary embodiment and FIG. 5 is a cross-sectional view of the assembly wall of FIG. 4.

Referring to FIGS. 4 and 5, the double stud type assembly wall 200 has substantially the same or similar construction and characteristics to those of the stagger stud type assembly wall 100 described with reference to FIGS. 1 to 3. In FIGS. 4 and 5, the difference between the assembly walls 100 and 200 is that stud members 220*a*, 220*b* are arranged in double lines and thus insulation members 230*a*, 230*b* are also arranged in double lines.

To avoid repeated descriptions of the components described with reference to FIGS. 1 to 3, the assembly wall according to this embodiment will be described in terms of different features. As will be recognized by one having ordinary skill in the art, reference numerals 212, 240, and 242 in FIGS. 4 and 5 correspond to reference numerals 112, 140, and 142, in FIGS. 1-3; namely referring to an additional layer, a sheet member and a second perforated hole respectively.

In this embodiment, the stud members 220*a*, 220*b* are arranged along two lines in a space between plate members 210. That is, the stud members 220*a*, 220*b* are individually placed along two lines on the inner surfaces of the plate members 210. Besides, the structure, shape and material of the stud members 220*a*, 220*b* are the same as those of the stagger stud type assembly wall 100 of FIGS. 1 and 3.

Further, such arrangement of the stud members 220*a*, 220*b* allows the insulation members 230*a*, 230*b* to be arranged in two lines along the two lines of the stud members 220*a*, 220*b*.

Meanwhile, it will be apparent to those skilled in the art that an assembly structure including the assembly wall 100 or 200 and a reinforced structure (not shown) supporting the assembly wall 100 or 200 belongs to the spirit and scope of the present invention.

Herein, some exemplary embodiments of the present invention have been described herein.

However, it should be understood by those skilled in the art that these embodiment are provided for illustrative purpose only and should not be construed in any way as limiting the present invention. Rather, it should be understood that various modifications, changes, alterations, and equivalent embodiments can be made without departing from the spirit and scope of the present invention, as defined only by the following claims and equivalents thereof.

The invention claimed is:

1. An assembly wall having improved sound absorption/insulation performance, comprising:

plate members separated from each other to face each other and each forming at least one layer;

stud members alternately placed on different inner surfaces of the plate members and comprising a web formed with a plurality of first perforated holes having at least one diameter and configured for sound absorption;

an insulation member interposed in a space defined between the plate members and the stud members; and a sheet member adjoining an outer surface of the insulation member, the sheet member interposed along with the insulation member in the space between the plate members and the stud members, and formed with a plurality of second perforated holes having at least one diameter configured for sound absorption, wherein the sheet member, the plate members, and the stud members form hollow spaces of resonators configured for sound absorption in a low frequency band, and wherein the diameters of the first and second perforated holes are selected for sound absorption of a frequency band.

2. The assembly wall of claim 1, wherein the first perforated holes and the second perforated holes have different diameters depending on a major sound absorption frequency.

3. The assembly wall of claim 2, wherein the first perforated holes and the second perforated holes have a diameter ranging from 0.1 mm to 5 mm.

4. The assembly wall of claim 1, wherein the plate members comprise a material having sound insulation and fireproof functions.

5. The assembly wall of claim 4, wherein the plate members comprise one material selected from among gypsum boards, magnesium oxide (MgO) boards, ceramic boards, cement boards, and lightweight concrete panels.

6. The assembly wall of claim 1, wherein the insulation member comprises a material having thermal insulation and sound absorption functions.

7. The assembly wall of claim 6, wherein the insulation member comprises one of rock wool, mineral wool, glass wool, ceramic fibers, polyethylene terephthalate (PET) nonwoven fibers, cellulose fibers, and various foaming materials.

8. An assembly structure having improved sound absorption/insulation performance, comprising:

an assembly wall, the assembly wall comprising:

plate members separated from each other to face each other and each forming at least one layer, stud members alternately placed on different inner surfaces of the plate members and comprising a web formed with a plurality of first perforated holes having at least one diameter and configured for sound absorption, an insulation member interposed in a space defined between the plate members and the stud members, and a sheet member adjoining an outer surface of the insulation member, the sheet member interposed with the insulation member in the space between the plate members and the stud members, and formed with a plurality of second perforated holes having at least one diameter configured for sound absorption, wherein the sheet member, the plate members, and the stud members form hollow spaces of resonators configured for sound absorption a low frequency band, and wherein the diameters of the first and second perforated holes are sleeted for sound. absorption of a frequency band; and a reinforced structure supporting the assembly wall.

* * * * *